US006997488B2

(12) United States Patent
Kürten et al.

(10) Patent No.: US 6,997,488 B2
(45) Date of Patent: Feb. 14, 2006

(54) ROTARY-LATCH LOCK

(75) Inventors: Ralf Kürten, Ratingen (DE); Edvard Rückert, Velbert (DE)

(73) Assignee: Witte-Velbert GmbH & Co. KG, Velbert (DE)

( * ) Notice: Subject to any disclaimer, the term of this patent is extended or adjusted under 35 U.S.C. 154(b) by 0 days.

(21) Appl. No.: 10/670,759

(22) Filed: Sep. 24, 2003

(65) Prior Publication Data

US 2004/0232706 A1 Nov. 25, 2004

(30) Foreign Application Priority Data

Sep. 28, 2002 (DE) ..... 102 45 402

(51) Int. Cl.
*E05C 3/06* (2006.01)

(52) U.S. Cl. ..... 292/201; 292/216; 292/210; 292/DIG. 22; 292/341.16

(58) Field of Classification Search ..... 292/201, 292/210, 216, DIG. 22, DIG. 65, 144, 341.16
See application file for complete search history.

(56) References Cited

U.S. PATENT DOCUMENTS 5,078,436 A * 1/1992 Kleefeldt et al. ..... 292/201
5,419,597 A * 5/1995 Brackmann et al. ..... 292/201
6,019,402 A * 2/2000 Arabia et al. ..... 292/216
6,076,868 A * 6/2000 Roger et al. ..... 292/201
6,386,600 B1 * 5/2002 Kalsi ..... 292/201
6,435,575 B1 * 8/2002 Pajak et al. ..... 292/216
6,517,128 B1 * 2/2003 Perkins et al. ..... 292/216
6,557,911 B1 * 5/2003 Nelsen et al. ..... 292/216
6,565,131 B1 * 5/2003 Roos ..... 292/201
6,568,720 B1 * 5/2003 Szablewski ..... 292/201
6,575,507 B1 * 6/2003 Reddmann ..... 292/201

FOREIGN PATENT DOCUMENTS

DE 10 105445 4/2002

* cited by examiner

*Primary Examiner*—Brian E. Glessner
*Assistant Examiner*—Christopher Boswell
(74) *Attorney, Agent, or Firm*—Martin A. Farber

(57) ABSTRACT

The invention relates to a rotary-latch lock (1) having a rotary latch (6) which is retained in a locked position by a catch (9), and having an actuating member (19) which can be displaced by an electric motor from a starting position into an actuating position and is intended for pivoting the catch (9) into a release position, in which the rotary latch (6) can pivot into an open position. In order to optimize the functioning of the rotary-latch lock, the invention proposes to provide a release member (24) which by means of the rotary latch (6), as the latter rotates into the open position, releases the actuating member (19) for the catch (9) for return displacement into the starting position.

13 Claims, 4 Drawing Sheets

ROTARY-LATCH LOCK

FIELD AND BACKGROUND OF THE INVENTION

The invention relates to a rotary-latch lock having a rotary latch which is retained in a locked position by a catch, and having an actuating member which can be displaced by an electric motor from a starting position into an actuating position and is intended for pivoting the catch into a release position, in which the rotary latch can pivot into an open position.

A rotary-latch lock of the type in question is known from DE 101 05 445 A1, the electromotive drive, for opening the rotary-latch lock, driving a spindle nut. In this case, a screw spindle, which is supported on a sliding shoulder and constitutes the actuating member, is displaced in the axial direction. This displacement is utilized in order to move the catch out of its engagement position. As soon as this has taken place, the action of the sliding shoulder in relation to the screw spindle stops. This then passes into a second rotation-prevention position, and the screw spindle, following only a small amount of return displacement, moves back, under spring loading, into the starting position. The screw spindle here executes simultaneous rotary and axial movements, the rotary movement being less than 360°. This means that the electromotive drive does not take effect during the axial return displacement of the screw spindle.

SUMMARY OF THE INVENTION

The object on which the invention is based is to optimize the functioning of a rotary-latch lock of the generic type.

This object is achieved in the case of a rotary-latch lock, this being based on the provision of a release member which by means of the rotary latch, as the latter rotates into the open position, releases the actuating member for the catch for return displacement into the starting position.

Other features are explained hereinbelow with reference to the main subject matter of the invention.

Such a configuration provides a rotary-latch lock of the type in question which has an increased utility value. During the opening actuation of the rotary-latch lock, which may advantageously be assigned to tailgates of motor vehicles, the actuating member moves from its starting position into the actuating position and, in the latter, pivots the catch into the release position in relation to the rotary latch. The actuating member remains in this actuating position, until such time as the rotary latch has rotated to the extent where it actuates a release member, which allows return displacement of the actuating member into the starting position. This configuration rules out the situation where, in the event of the tailgate being subjected to loading which prevents the rotary latch from rotating into the open position, the opening operation has to be re-initiated. This case may occur, for example, if there is a load of snow acting on the tailgate. The catch can basically be pivoted in the direction of the rotary latch only when the latter has already rotated open to some extent. The situation where the tailgate opens as a result of a catch re-engaging with the rotary latch is thus eliminated. An advantageous development can be seen according to the invention in that the actuating member can be displaced from the starting position into the actuating position counter to the restoring force of a spring. There is thus no need for the actuating member to be displaced from the actuating position into the starting position by an electromotive drive since this takes place on account of the restoring force of the spring. The principle according to the invention is realized in a straightforward manner in that the actuating member is an axially displaceable worm which is arranged in a non-rotatable manner on a shaft which is driven in rotation by a motor and has a cross-shaped profile, a protrusion of the release member engaging in the worm helix. With the electromotive drive initiated, the protrusion of the release member causes the actuating member or the worm to be displaced forward into the actuating position, to be precise counter to the restoring force of the spring. If the electromotive drive stops operating following sufficient further displacement of the worm, then the protrusion of the release member retains the worm in the actuating position, in which the catch has released the rotary latch. It is only when the rotary latch is rotated into the open position that the release member is displaced by the rotary latch such that the protrusion leaves the helix of the worm. This allows the spring to take effect, the spring guiding the worm back into its starting position. The operation of opening the tailgate has nevertheless already started then, with the result that the catch cannot move into the active position in relation to the rotary latch. Furthermore, it is provided according to the invention that the spring is a helical compression spring which is seated on the shaft. It is supported, on the one hand, on the lock housing and, on the other hand, on the worm. This makes it possible to realize a space-saving and weight-saving construction of the rotary-latch lock. In order to convert the longitudinal displacement of the actuating member into a release displacement of the catch, the actuating member acts on a disengaging section of a catch arrangement. This can take place directly or indirectly. For example, during its axial displacement on the shaft, the actuating member can act on the catch via a lever. It proves to be advantageous if the shaft engages through the fork interior of a fork-like end of the catch, said end forming the disengaging section. This results in the actuating member acting in optimum fashion on the catch. In respect of the control of the worm, it proves to be advantageous if the release member is a lever which can be pivoted about a lock-housing-mounted pin. If this lever is subjected to the action of the rotary latch during the opening rotation of the latter, then the protrusion, at the same time, leaves the worm helix and releases the worm for return displacement into the starting position. The release member performs a double function in that the protrusion is assigned to one lever arm and another lever arm, in particular of the same member, follows the rotary latch, in contact therewith. It is also then advantageous according to the invention to provide a disengaging protrusion which projects radially from the rotary latch and is intended for the other lever arm of the release member. This means that the release member is always released once the rotary latch has covered a defined opening angle of rotation. This reliably prevents the situation where the catch can re-engage, which would make it necessary to re-initiate an opening operation. In order to ensure that the electric motor stops operating following forward displacement of the actuating member, the shaft runs up against a block when the release position of the catch is reached. According to the invention, then, it is also provided that the motor remains blocked even when the actuating member has moved back once the rotary-latch lock has been opened. This is achieved by a stop which is assigned in a rotationally fixed manner to the shaft, in particular at the end thereof, and strikes against a mating stop when the release position of the catch is reached. This means that, when the tailgate is open, the electric motor is not driven, and nor, consequently, is the shaft. On the one hand, this results in a low-noise configuration of the rotary-latch lock. On the other hand, the amount of energy required is reduced. According to the invention, it is provided that the stop is a radial protrusion and the mating stop is assigned to the disengaging section. The stop of the shaft is assigned to the worm-like actuating member such that it always moves correctly into the region of the mating stop of the catch, which is forced in the release direction by the actuating member.

BRIEF DESCRIPTION OF THE DRAWINGS

Two exemplary embodiments of the invention are explained hereinbelow with reference to the drawings, in which.

DETAILED DESCRIPTION OF THE PREFERRED

Figure 2:
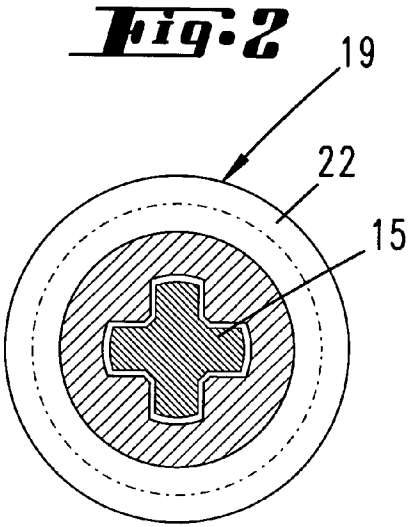
FIG. 2 shows the section along line II—II in FIG. 1.

The illustrated rotary-latch lock, formed according to the invention, of the first embodiment according to FIGS. 1 to 4 is designated as a whole by 1. It is used, in particular, on tailgates (not illustrated) of passenger vehicles. For this purpose, the rotary-latch lock 1 is secured predominantly on a tailgate and interacts with a bodywork-mounted mating locking part 2. The latter may be, for example, a locking bracket which is bent in a U-shaped manner.

In specific terms, the rotary-latch lock 1 has a lock housing 3 with an inlet slot 4 which runs in the locking direction and is intended for the mating locking part 2. On one side of the inlet slot 4, a rotary latch 6 with a fork opening 7, which is open at the periphery and is intended for intercepting the mating locking part 2, is mounted on a pin 5. On the other side of the inlet slot 4, the lock housing 4 bears a bearing journal 8, about which a catch 9 is arranged in a rotatable manner. Both the rotary latch 6 and the catch 9 are each assigned a leg spring (not illustrated). One leg spring subjects the catch 9 to loading in the blocking-engagement direction in relation to the rotary latch 6, while the other leg spring attempts to pivot the rotary latch in a clockwise direction into the open position.

Opposite the rotary latch, the catch 9 forms a blocking protrusion 10 on the side which is directed toward the rotary latch 6, this blocking protrusion interacting with a main latching recess 11 of the rotary latch 6 and a preliminary latching recess 12 of the latter arranged downstream of the main latching recess.

The single-armed catch 9 terminates in a fork-like end 13, which forms a disengaging section. A shaft 15 with a cross-shaped profile engages through the fork interior 14 of said fork-like end. This shaft is mounted in a rotatable manner in the lock housing 3. Seated in a rotationally fixed manner at one end of the shaft 15 is a cylindrical wheel 16, with which the drive pinion 17 of an electric motor 18 assigned to the lock housing 3 meshes.

The shaft 15 bears an actuating member 19, configured in the form of a worm, in the region between the fork-like end 13 and the cylindrical wheel 16. The worm 19 is seated in a form-fitting manner on the cross-shaped profile of the shaft 15, that is to say is assigned to the latter in a rotationally secured manner. It is nevertheless possible for the worm 19 to be displaced axially on the shaft 15. On the side which is located opposite the drive end of the shaft, the latter bears a helical compression spring 20, which encloses the shaft and is supported, on the one hand, on the lock housing 3 and, on the other hand, on the worm 19. For this purpose, that end of the worm 19 which is directed toward the fork-like end 13 is provided with a cup-like bore 21, the other end of the compression spring 20 being supported on the cup base thereof. The form fit between the shaft 15 and the worm 19 is provided on the far side of said cup-like bore.

The worm helix 22 interacts with a protrusion 23 of a release member 24. The latter is an angled lever which can be pivoted about a lock-housing-mounted pin 25. According to the drawings, the pin 25 is located above the pin 5, approximately level with the drive pinion 17. The angled lever 24 bears the protrusion 23 on one lever arm 26, while the other lever arm 27 projects into the rotary region of the rotary latch 6 and interacts there with a radially projecting disengaging protrusion 28 of the rotary latch 6. This disengaging protrusion 28 runs approximately perpendicularly to the fork opening 7.

As the drawings illustrate, the other lever arm 27 runs in the region between the rotary latch 6 and the worm 19. A torsion spring 29, which is arranged on the pin 25, subjects the release lever 24 to loading in the clockwise direction, with the result that the protrusion 23 always tries to engage in the helix 22 of the worm 19 or actuating member.

Figure 1:
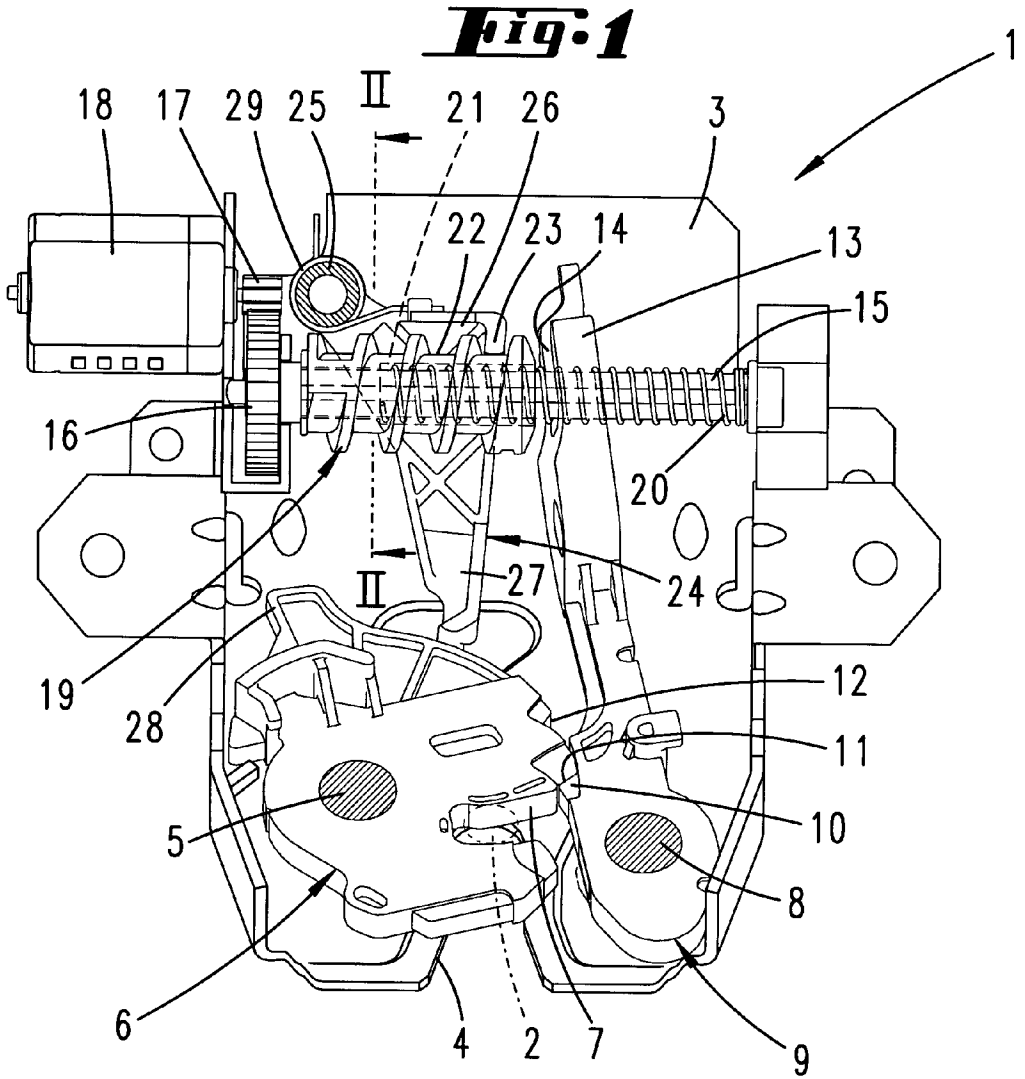
FIG. 1 shows a view of a rotary-latch lock configured according to the invention in its locking position.
Figure 4:
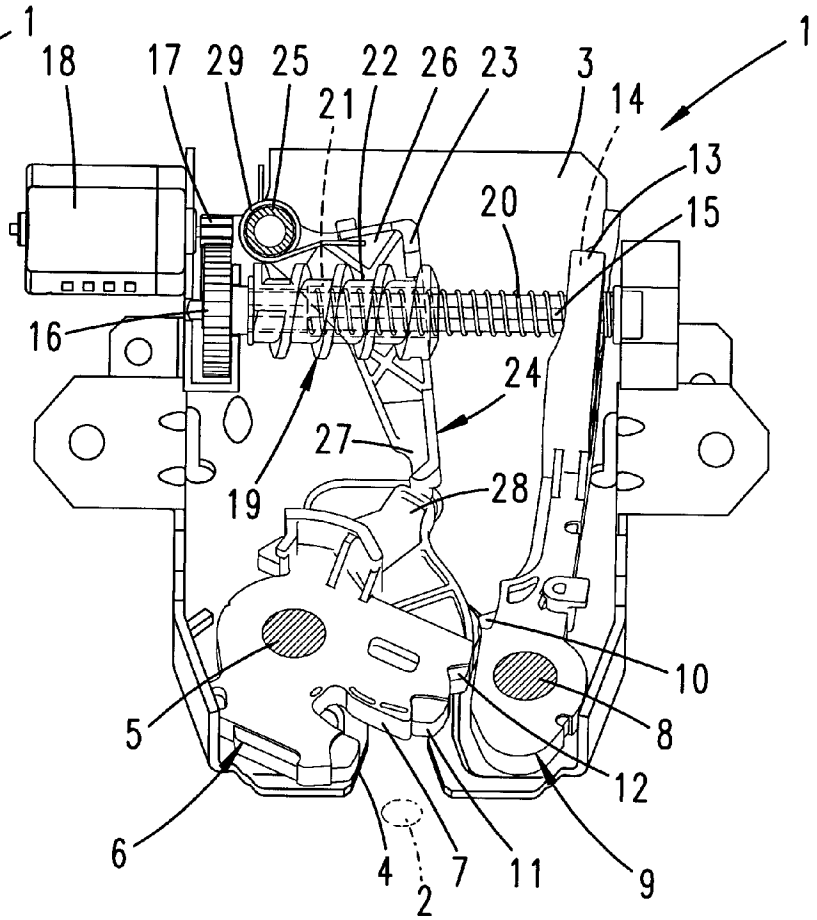
FIG. 4 shows the follow-up illustration to FIG. 3, in which case, as a result of the rotary latch rotating in the opening direction, the disengaging protrusion thereof has displaced the release member into the release position, with the actuating member or worm displaced into the starting position under the action of the restoring force.
Figure 3:
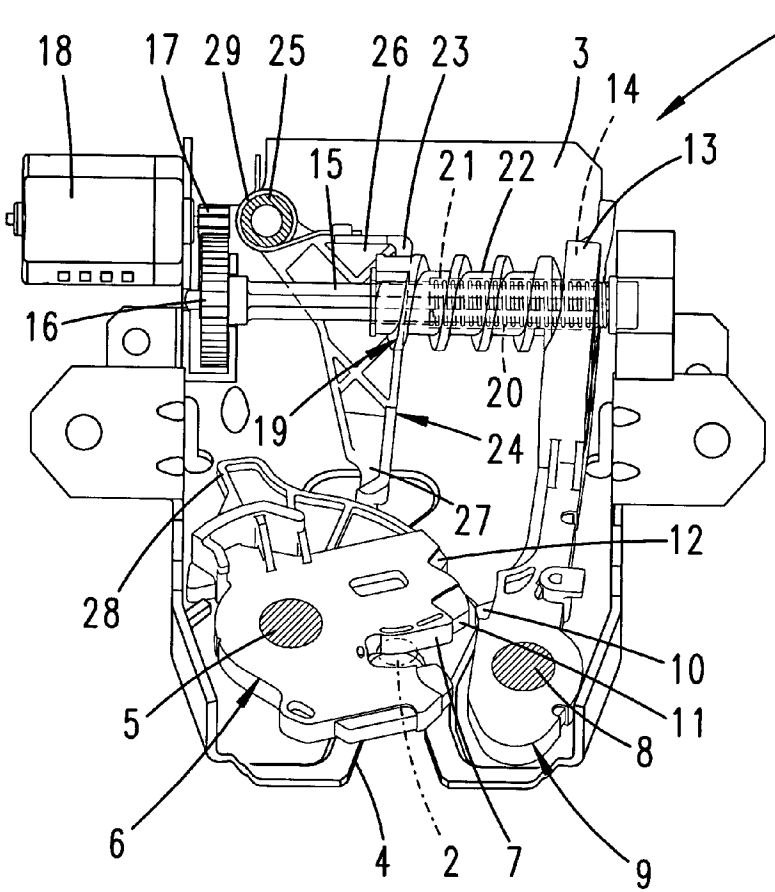
FIG. 3 shows the rotary-latch lock with the actuating member displaced into the actuating position and the catch retained in the release position in relation to the rotary latch.

Functioning is as follows:

If the rotary-latching lock assumes the locking position illustrated in FIG. 1 and if the rotary-latch lock or the tailgate is to be opened, then the first step is to initiate and/or energize the electric motor 18. This may be done, for example, via remote actuation or by actuation using a handle, key, etc. As the electric motor 18 is energized, it drives the shaft 15 via the drive pinion 17 and cylindrical wheel 16. The actuating member 19 or the worm rotates along therewith. Via the protrusion 23 of the release member 24 engaging in the worm helix 22, the worm 19 is thus forcibly subjected to longitudinal displacement on the shaft 15 in the direction of the fork-like end 13 of the catch 9. That end of the worm 19 which is directed toward the fork-like end 13 acts on the catch 9 and lifts it out into the release position in relation to the rotary latch 6. In this case, the blocking protrusion 10 of the catch 9 leaves the main latching recess 11 of the rotary latch 6, with the result that the position according to FIG. 3 is established.

With the worm-like actuating member 19 displaced forward, the drive of the electric motor 18 stops operating. The worm 19 remains in its actuating position, which constitutes a storage position. It is thus not possible for the catch 9 to engage. If, then, there should be any load resting on the tailgate, for example a load of snow, the catch 9 cannot assume its locking position again. It is only during opening of the tailgate that the rotary latch 6 can rotate in the opening direction. During this opening rotation, the disengaging protrusion 28 acts on the other lever arm 27 of the release member 24 and pivots the latter, the protrusion 23 being lifted out of the worm helix 22. This lifting-out action takes place when the preliminary latching recess 12 has passed the blocking protrusion 10 of the catch 9. The action of the protrusion 23 being lifted out of the worm helix 22 may be accompanied by the helical compression spring 20 taking effect, this spring transferring the actuating member 19 or the worm out of its actuating position into the starting position according to FIG. 4.

If, following return displacement of the worm 19, the protrusion 23, rather than being able to engage in the worm helix 22, is supported on the outside of the thread helix of the worm, it is nevertheless the case, as the shaft 15 starts to rotate, that the protrusion engages correctly in the worm helix 22 and thus causes the worm to be displaced forward into the actuating position.

Figure 8:
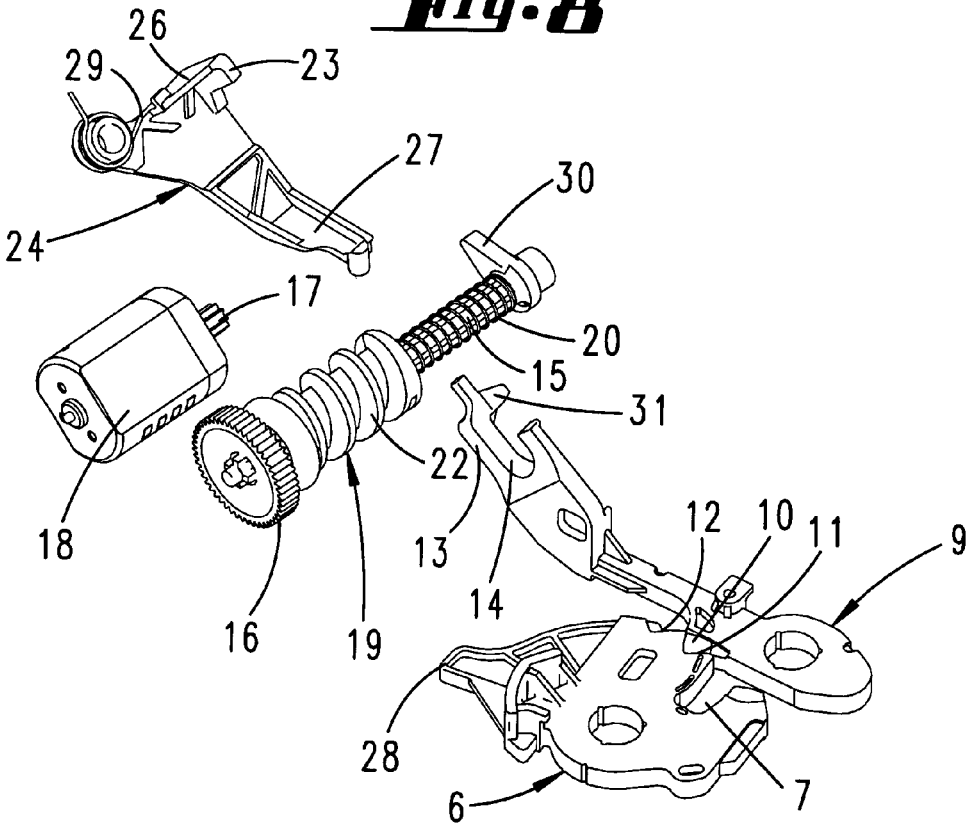
FIG. 8 shows a perspective illustration of the components which interact with one another in the case of this second version.

The second embodiment of the rotary-latch lock 1 is similar to the first embodiment. The same components are provided with the same designations. In contrast, then, that end of the shaft 15 which is located opposite the cylindrical wheel 16 bears a stop 30 which is assigned to it in a rotationally fixed manner. This means that, as the shaft 15 rotates, the stop 30 also circulates. As in the first embodiment, the shaft 15 engages through the fork-like end 13 of the catch 9. The associated fork interior is likewise designated 14. The top region of one fork leg is adjoined, in the rearward direction, by a mating stop 31, which is able to pivot into the rotary path of the stop 30. As can be seen from FIG. 8 in particular, the stop 30 is a radial protrusion of the shaft 15. The mating stop 31, in contrast, is assigned to the disengaging section of the catch 9, that is to say, in the present case, to the fork-like end 13.

Figure 5:
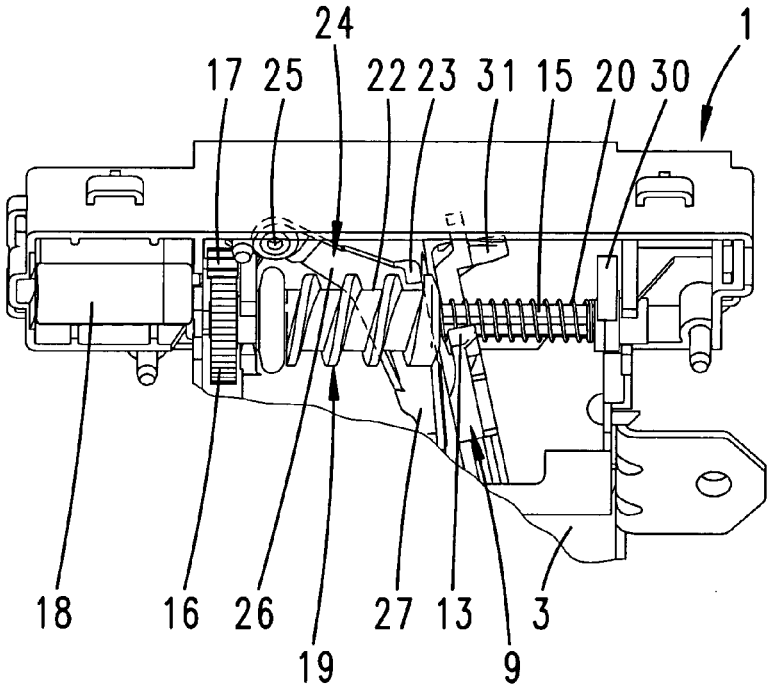
FIG. 5 shows the second embodiment of the rotary-latch lock in a partial view corresponding to the locking position.
Figure 6:
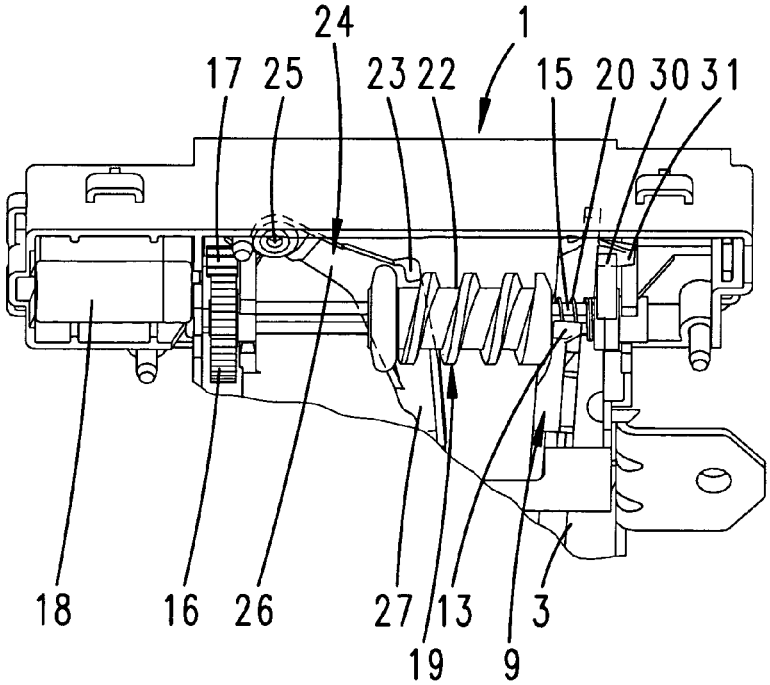
FIG. 6 shows the follow-up illustration to FIG. 5, to be precise with the actuating member displaced forward, this member pivoting the catch into the release position, in which the stop and mating stop engage against one another.

The lock according to the second embodiment functions as follows:

FIG. 5 shows the locking position of the rotary latch lock 1. The action of opening the rotary-latch lock or the tailgate bearing the same requires the electric motor 18 to be initiated. This is energized for approximately 600 ms. This results, via the toothed-wheel drive, in the shaft 15, with the worm-like actuating member 19, circulating. Since the protrusion 23 of the release member 24 penetrates into the worm helix 22, this results in the actuating member 19 being displaced longitudinally on the shaft 15 in the direction of the fork-like end 13 counter to the action of the helical compression spring 20, which is supported at the end of the shaft 15. The stop 30 is positioned such that, in the end phase of the displacement of the actuating member 19, it engages correctly against the mating stop 31 of the catch 9 pivoting into the release position, see FIG. 6. This means that the shaft 15 runs up against a block when the release position of the catch 9 is reached, to be precise once the electric motor has been energized for approximately 600 ms.

Figure 7:
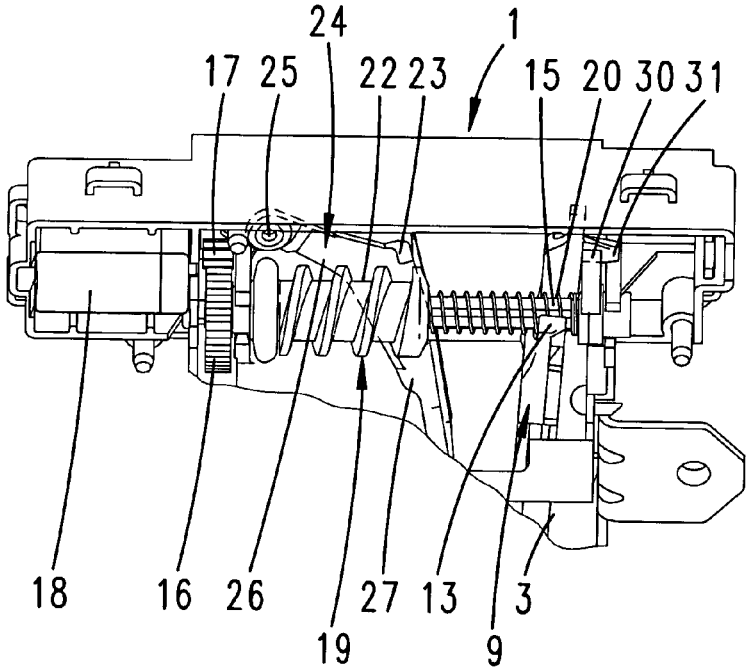
FIG. 7 shows the follow-up illustration to FIG. 6, to be precise with the actuating member displaced back once the rotary latch has been pivoted into the open position, but with the stop and mating stop remaining in the stop position, the electromotive drive being blocked in the process.

If the tailgate is then opened, this results in the rotary latch 6 rotating in the opening direction. The actuating member 19 prevents the released catch from engaging. In the end phase of the opening rotation, the disengaging protrusion 28 of the rotary latch 6 acts on the other lever arm 27 of the release member 24 and pivots the latter into the release position according to FIG. 7. The helical compression spring 20 can then displace the actuating member 19 back. The blocked position of the electric motor, however, is maintained since the stop 30 continues to butt against the mating stop 31 and the catch 9 is supported, by way of its blocking protrusion 10, on the periphery of the rotary latch 6 assuming the open position, as can be gathered, for example, from FIG. 4. This ensures that, in the end position, the drive of the electric motor 18 is blocked.

What is claimed is:

1. A rotary-latch lock (1) having a rotary latch (6) which is retained in a locked position by a catch (9), and having an actuating member (19) which can be displaced by an electric motor from a starting position into an actuating position and serves for pivoting the catch (9) into a release position, the release position of the catch (9) enabling the rotary latch (6) to pivot into an open position, wherein a release member (24) is operative by means of the rotary latch (6), as the latter rotates into the open position, to release the actuating member (19) for the catch (9) for return displacement into the starting position; and wherein the actuating member 19 comprises a worm helix (22) engaging with the release member (24) during an unlocking of the latch (6), the release member (24) displacing the worm helix along a shaft (15) during a rotation of the shaft by the motor for driving the catch (9) into the release position, wherein rotation of the latch into the open position disengages the release member (24) from the worm helix allowing the worm helix to be displaced back by spring force to the start position.

2. The rotary-latch lock as claimed in claim 1, wherein the actuating member (19) can be displaced from the starting position into the actuating position counter to the restoring force of a spring (20).

3. The rotary-latch lock as claimed in claim 2, wherein the actuating member (19) is an axially displaceable worm which is arranged in a non-rotatable manner on the shaft (15) which is driven in rotation by a motor, a protrusion (23) of the release member (24) engaging in the worm helix (22).

4. The rotary-latch lock as claimed in claim 3, wherein the spring (20) is a helical compression spring which is seated on the shaft (15).

5. The rotary-latch lock as claimed in claim 3, wherein the shaft (15) engages through the fork interior (14) of a fork-like end (13) of the catch (9), said end forming the disengaging section.

6. The rotary-latch lock as claimed in claim 3, wherein the protrusion (23) is assigned to one lever arm (26) and another lever arm (27), of the release member (24), and follows the rotary latch (6), in contact therewith.

7. The rotary-latch lock as claimed in claim 3, wherein the shaft (15) runs up against a block when the release position of the catch (9) is reached.

8. The rotary-latch lock as claimed in claim 3, further comprising a stop (30) which is assigned in a rotationally fixed manner to the shaft (15), and strikes against a mating stop (31) when the release position of the catch (9) is reached.

9. The rotary-latch lock as claimed in claim 8, wherein the stop (30) is a radial protrusion and the mating stop (31) is assigned to the disengaging section.

10. The rotary-latch lock as claimed in claim 8, wherein the stop (30) is at an end of the shaft (15).

11. The rotary-latch lock as claimed in claim 1, wherein the actuating member (19) acts on a disengaging section of a catch arrangement.

12. The rotary-latch lock as claimed in claim 1, wherein the release member (24) is a lever which can be pivoted about a lock-housing-mounted pin (25).

13. The rotary-latch lock as claimed in claim 1, further comprising a disengaging protrusion (28) which projects radially from the rotary latch (6) and is intended for another lever arm (27) of the release member (24).

* * * * *